US006241023B1

(12) United States Patent
Krauss et al.

(10) Patent No.: US 6,241,023 B1
(45) Date of Patent: Jun. 5, 2001

(54) UNLOCKING PACKER SETTING METHOD AND DEVICE

(75) Inventors: Christiaan D. Krauss, Houston; David E. Hirth, Pasadena, both of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/439,325

(22) Filed: Nov. 12, 1999

Related U.S. Application Data

(60) Provisional application No. 60/108,043, filed on Nov. 12, 1998.

(51) Int. Cl.[7] ..... E21B 23/00; E21B 23/06

(52) U.S. Cl. ..... 166/387; 166/125; 166/181; 166/237

(58) Field of Search ..... 166/123, 125, 166/181, 237, 387

(56) References Cited

U.S. PATENT DOCUMENTS

| | | | | |
|---|---|---|---|---|
| 1,839,243 | * | 1/1932 | Mechling et al. | 166/125 X |
| 2,991,835 | * | 7/1961 | Schwab | 166/125 X |
| 4,310,048 | * | 1/1982 | Mott | 166/212 |
| 4,388,971 | * | 6/1983 | Peterson | 166/387 |
| 4,440,233 | | 4/1984 | Baugh et al. | 166/382 |
| 4,572,290 | | 2/1986 | Clifton | 166/123 |
| 4,832,129 | | 5/1989 | Sproul et al. | 166/387 |
| 5,092,402 | | 3/1992 | Perricone et al. | 166/113 |
| 5,141,053 | * | 8/1992 | Restarick et al. | 166/120 |
| 5,143,015 | * | 9/1992 | Lubitz et al. | 166/187 |
| 5,186,258 | * | 2/1993 | Wood et al. | 166/387 |
| 5,727,632 | * | 3/1998 | Richards | 166/387 |
| 5,813,458 | | 9/1998 | Smith, Jr. et al. | 166/182 |
| 6,009,943 | * | 1/2000 | Yokley et al. | 166/125 |

FOREIGN PATENT DOCUMENTS 2321919A 8/1998 (GB) .

* cited by examiner

*Primary Examiner*—George Suchfield
(74) *Attorney, Agent, or Firm*—Steve Rosenblatt

(57) ABSTRACT

A dog sub is provided for use in an assembly for running liners with weight-set packers and/or other mechanically or hydraulically actuated devices that need to be located. The dogs are retained by a sleeve so that an applied pickup force to determine that the running string had released from the liner can be applied which even results in removal of the dog sub from the extension tube of the weight-set packer. The dogs are held in a retracted position, even if taken out of the extension tube initially. Thereafter, the dog sub is supported off the extension tube and the locking sleeve on the dogs is liberated, with the dogs inside the extension tube. A subsequent pickup force allows the dogs to move outwardly, whereupon a subsequent setdown force locates the dogs on the setting extension tube. A subsequent setdown force sets the packer and breaks a breakable member, such as a shear pin. Upon removal to the surface, surface personnel can see that a shear pin has broken to indicate that the requisite force has been applied to the weight-set packer.

20 Claims, 10 Drawing Sheets

UNLOCKING PACKER SETTING METHOD AND DEVICE

This application claims priority from a Provisional Patent Application entitled Unlocking Packer Setting Method & Device, filed by the same inventors on Nov. 12, 1998, and accorded Ser. No. 60/108,043.

FIELD OF THE INVENTION

The field of this invention relates to devices and methods for setting packers and/or locating other types of tools in a liner string, particularly in the context of weight-set packers in deviated wellbores.

BACKGROUND OF THE INVENTION

Packers are used in many applications downhole. In one application, packers are run with a liner which is to be hung in the wellbore. In these applications, a running tool is used with a tubing string to position the liner and set the hanger. After the liner hanger is set, it is common practice to release the running tool and raise the work string several feet. The work string is raised prior to cementing the liner to check for weight loss as an indication that the running tool has released from the liner. Thereafter, it is desirable to lower the work string and apply a downward force through the running tool and into the liner during cementing so as to counteract the upward forces due to hydraulics when the cement is pumped through the liner. When a compression-set liner top packer and/or another mechanical or hydraulic device in the string is used, a packer-setting device which consists of a dog sub is usually positioned just above the running tool. The dogs are compressed to fit inside an extension of the weight-set packer during run-in.

In the past due to deviation in wellbores, it was uncertain as to where the dogs would wind up when pulling up at the surface to ensure a release of the running tool from the liner. The problem in prior designs was that if the dogs were pulled out of the extension of the weight-set packer when testing for release of the running tool from the liner, a subsequent downward force would prematurely set the packer prior to the onset of the cementing job or prematurely locate the running string opposite another device which is mechanically or hydraulically operated. One solution that had been implemented was to put an unduly long extension tube on the weight-set packer to ensure that no matter how high (within reason) the dog sub was lifted that the dogs would remain inside the tube so that the string could be set down to resist the hydraulic forces occurring during the cementing operation. However, lengthening the extension tube provided a restriction against circulation of mud being displaced by the advancing cement. This would prolong the time required to complete the cementing and thus increase costs for the well owner. It could also adversely affect the quality of the cementing job.

In the past, dog subs such as disclosed in U.S. Pat. No. 5,813,458 ("the '458 patent") could be employed to facilitate the operations of cementing, followed by setting the weight-set packer. Furthermore, as disclosed in the '458 patent, a shear screw in the assembly could be used as a signal to surface personnel when extracting the dog sub to the surface that a sufficient force had been applied to the weight-set packer. However, the dogs in that patent were free to engage the extension tube if they inadvertently got pulled out of the extension tube during the procedure to determine that the running tool had released from the liner.

Accordingly, one of the objectives of the present invention is to provide a dog sub which can literally come out of a reasonably sized extension tube without release of the dogs to facilitate the step of determining that the running tool had released from the liner. Another objective is to then allow the dogs to be subsequently released when inside the extension so that thereafter, when removed from the extension, they can be used to set the weight-set packer and to provide the necessary signal to surface personnel that sufficient weight had been used to set the weight-set packer.

Another objective of the present invention is to facilitate the sequence of operations which involve setting the liner hanger, picking up the string as much as necessary to ensure disconnection of the running tool from the liner, setting back down into the liner and holding that position during cementing, picking up to allow the dogs to engage the top of the extension tube, setting down weight to set the packer, and to provide a signal to surface personnel that sufficient force has been applied to the weight-set packer. Accordingly, the objective of the present invention is to eliminate uncertainties of the prior art devices which could have catastrophic consequences if, during the pickup of the string to release the running tool from the liner, the dogs emerged form the extension tube on the packer. Should that occur, the running string would have to be pulled out of the hole and the dogs removed, followed by another trip back in the hole with the running string to facilitate the cementing job. Thereafter, the running string would have to be tripped out of the hole and some object located on the bottom end of the running string so that it would ultimately engage the extension tube on the weight-set packer to subsequently set the packer after the cementing job. The problem would be that the time delay involved in these extra trips would cause the formation to come back in around the liner, thus making circulation difficult for placement of the cement around the liner. On top of that, there are operational uncertainties of whether the weight-set packer could even be actuated at the conclusion of the cementing job with makeshift tools. Accordingly, one of the objectives of the present invention is to allow extraction of the dog sub from the extension tube without adverse consequences for the purpose of determining release of the running string from the liner. Those and other advantages of the method and apparatus of the present invention will become more apparent to those skilled in the art from a review of the detailed description of the preferred embodiment which appears below.

SUMMARY OF THE INVENTION

A dog sub is provided for use in an assembly for running liners with weight-set packers and/or other mechanically or hydraulically actuated devices that need to be located. The dogs are retained by a sleeve so that an applied pickup force to determine that the running string had released from the liner can be applied which even results in removal of the dog sub from the extension tube of the weight-set packer. The dogs are held in a retracted position, even if taken out of the extension tube initially. Thereafter, the dog sub is supported off the extension tube and the locking sleeve on the dogs is liberated, with the dogs inside the extension tube. A subsequent pickup force allows the dogs to move outwardly, whereupon a subsequent setdown force locates the dogs on the setting extension tube. A subsequent setdown force sets the packer and breaks a breakable member, such as a shear pin. Upon removal to the surface, surface personnel can see that a shear pin has broken to indicate that the requisite force has been applied to the weight-set packer.

BRIEF DESCRIPTION OF THE DRAWINGS

FIGS. 2*a–c* are, respectively, section views along lines A—A B—B, and C—C of FIG. 1 during run-in.

DETAILED DESCRIPTION OF THE PREFERRED EMBODIMENT

Figure 2A:
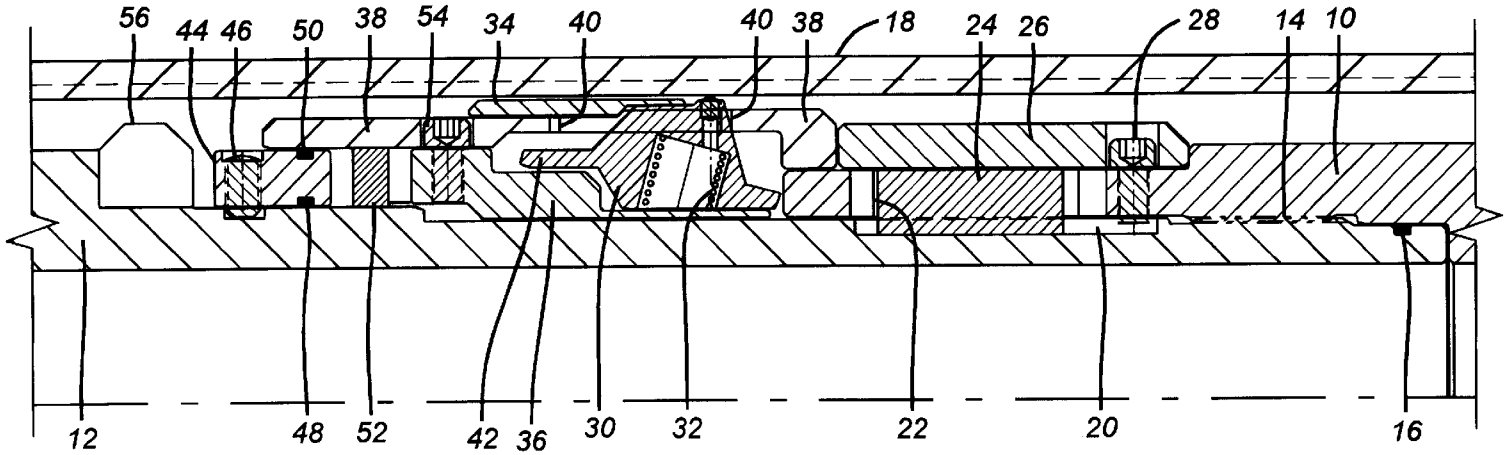

Referring to FIG. 2*a,* a lower mandrel 10 is secured to the top mandrel 12 at thread 14. O-ring 16 seals the connection of thread 14. The lower mandrel 10 is secured to the running tool (not shown), which in turn is connected to the liner and liner hanger (not shown). The weight-set packer (not shown except for its extension tube 18) is ultimately connected to the liner (not shown). Those skilled in the art will appreciate that a setdown force on the tube 18 sets the weight-set packer. It should also be noted that the top mandrel 12 is connected to the running string (not shown) for support from the surface. The top mandrel 12 has a longitudinal recess 20 which is aligned with a window 22 in the lower mandrel 10. A key 24 extends into recess 20 and through window 22 to rotationally lock the top mandrel 12 to the lower mandrel 10. Key 24 is retained by sleeve 26, which is in turn held by fastener or fasteners 28.

Figure 6A:
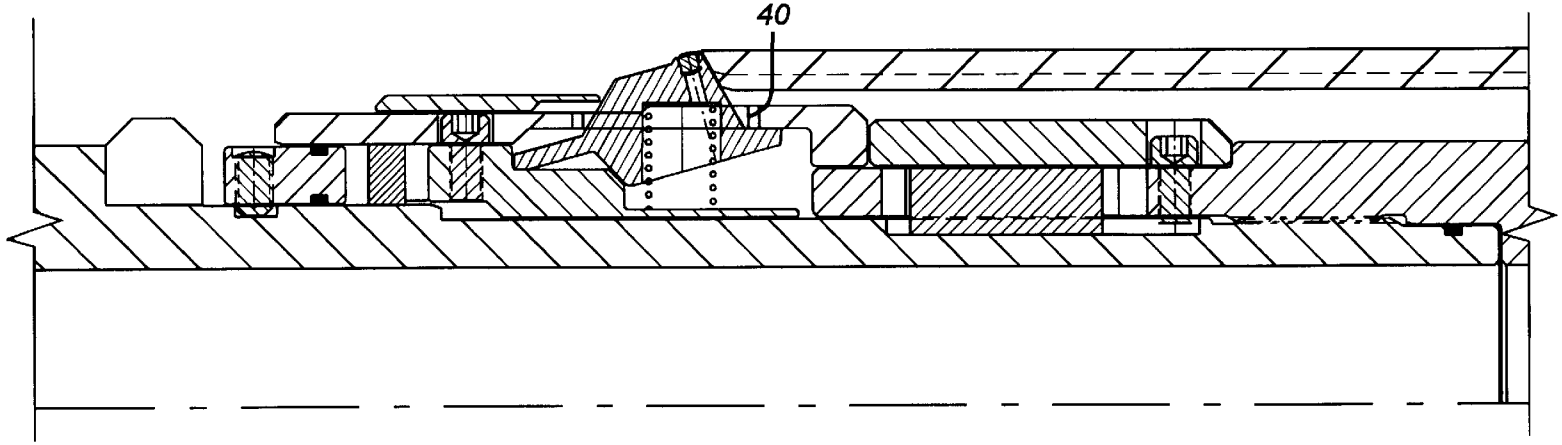
FIGS. 6*a–c* indicate removal of the dog sub from the extension tube and the engagement by the dogs of the extension tube for setting the weight-set packer.

A series of dogs 30 are each biased outwardly by a spring or other biasing mechanism 32. In the position shown in FIG. 2*a,* the dogs 30 are retained toward the top mandrel 12 by dog retainer sleeve 34. Dog 30 is retained between dog support 36 and cover 38. Cover 38 has an opening 40 through which the dog 30 can pivot outwardly, as shown in FIG. 6*a*. Each of the dogs 30 has a tab 42 which acts in conjunction with the spring 32 to create counterclockwise rotational motion of the dogs 30 when no longer retained by sleeve 34 and extension tube 18, as will be explained below.

Figure 7A:
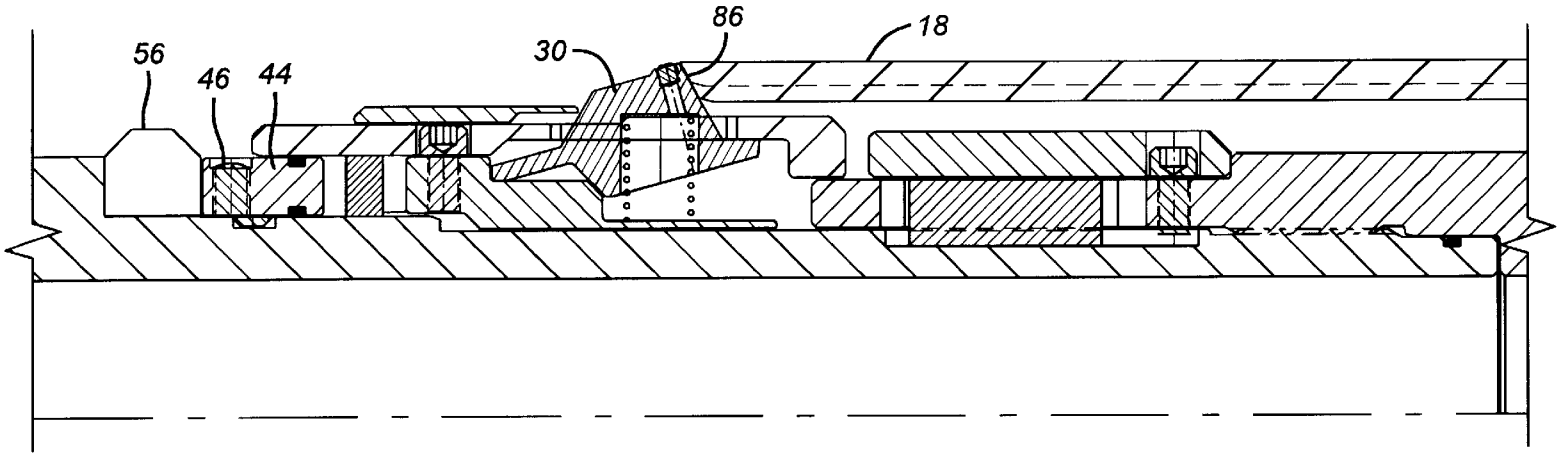
FIGS. 7*a–c* indicate breakage of a shear pin to provide the signal to surface personnel that an appropriate amount of force has been applied to the setting sleeve for the weight-set packer when the dog sub is removed to the surface.

A shear ring 44 is held to the top mandrel 12 by a shear pin 46. Those skilled in the art will appreciate that other techniques can be used to selectively retain the ring 44 to the top mandrel 12 without departing from the spirit of the invention. Ring 44 has an internal seal 48 and an external seal 50. Seal 50 seals against the cover 38, while seal 48 seals against the top mandrel 12. Located below the shear ring 44 is a thrust bearing assembly 52. The thrust bearing assembly 52 is retained above and below, respectively, by the shear ring 44 and dog support 36. The thrust bearing assembly 52 is retained internally by the top mandrel 12 and externally by the cover 38. A fastener 54 extends through the cover 38 and into dog support 36. A stop ring 56 acts as a travel stop for shear ring 44, as shown in FIG. 7*a*.

The thrust bearing assembly 52 allows the work string (not shown), connected to the top mandrel 12, to be rotated without rotating the dogs 30 to help in setting down weight on extension tube 18 with dogs 30. This occurs because rotation of top mandrel 12 rotates the lower mandrel 10 because they are rotationally locked at key 24. However, the assembly retaining the dogs 30, which includes the dog support 36 and the cover 38, is free to remain stationary as the top mandrel 12 rotates. With the shear pin 46 intact, as shown in FIG. 2*a,* rotation of the top mandrel 12 will also rotate the shear ring 44 on the other side of the thrust bearing assembly 52 from the stationary dog support 36.

Figure 2B:
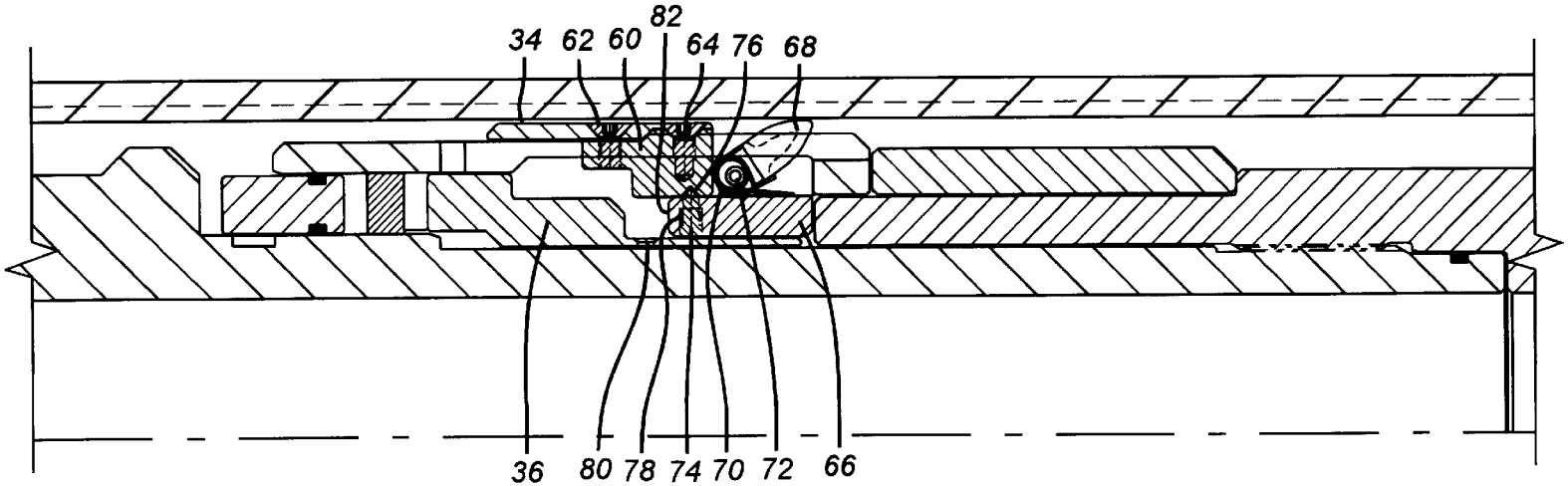
Figure 2C:
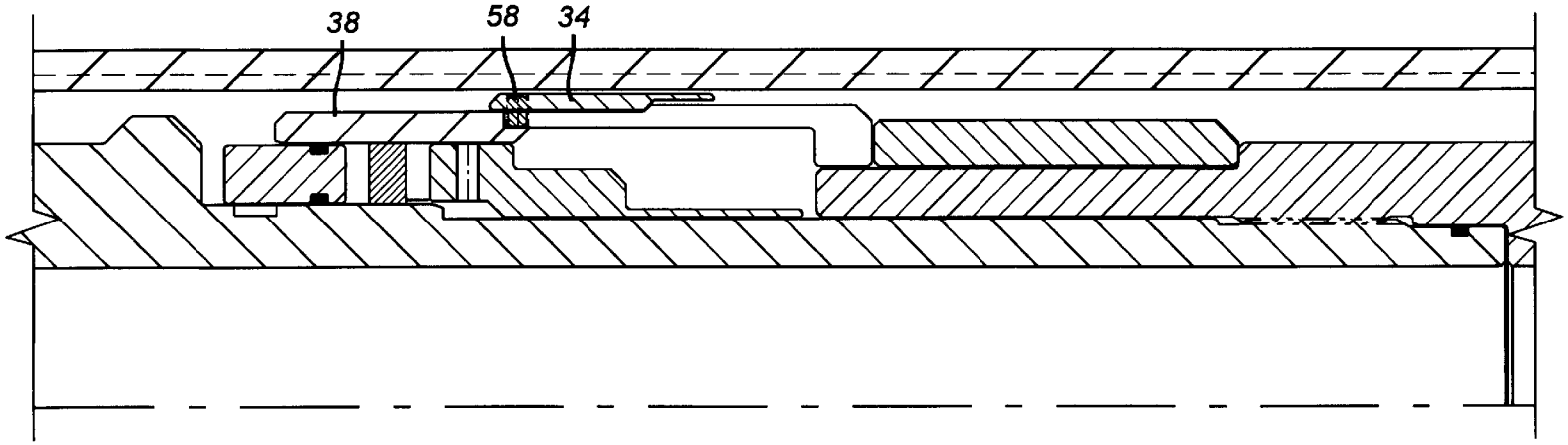
Figure 5A:
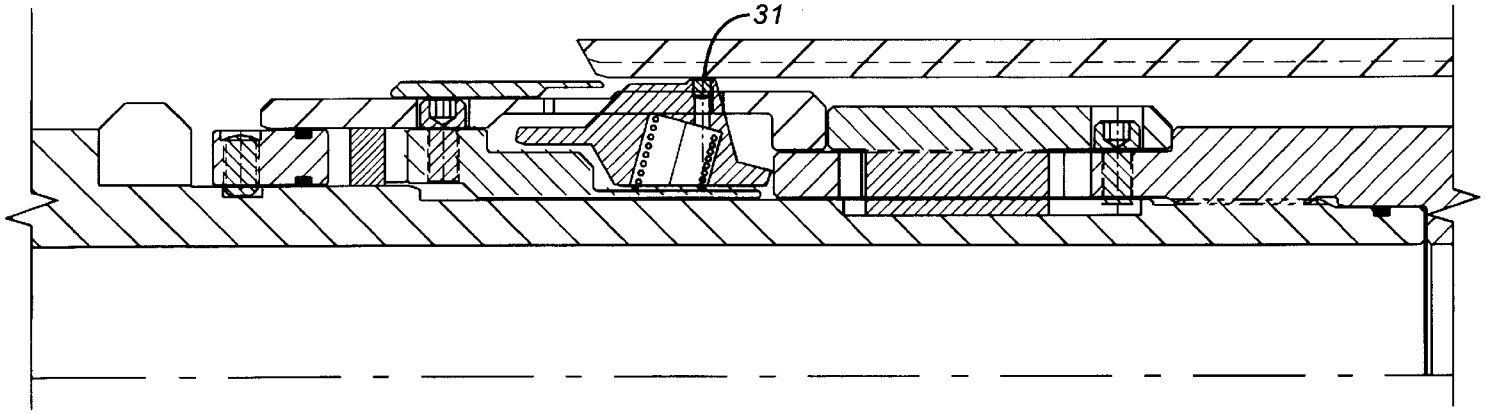
FIGS. 5*a–c* illustrate further downward movement into the extension tube upon further rotation of the fingers to liberate the dogs while inside the extension tube.
Figure 4A:
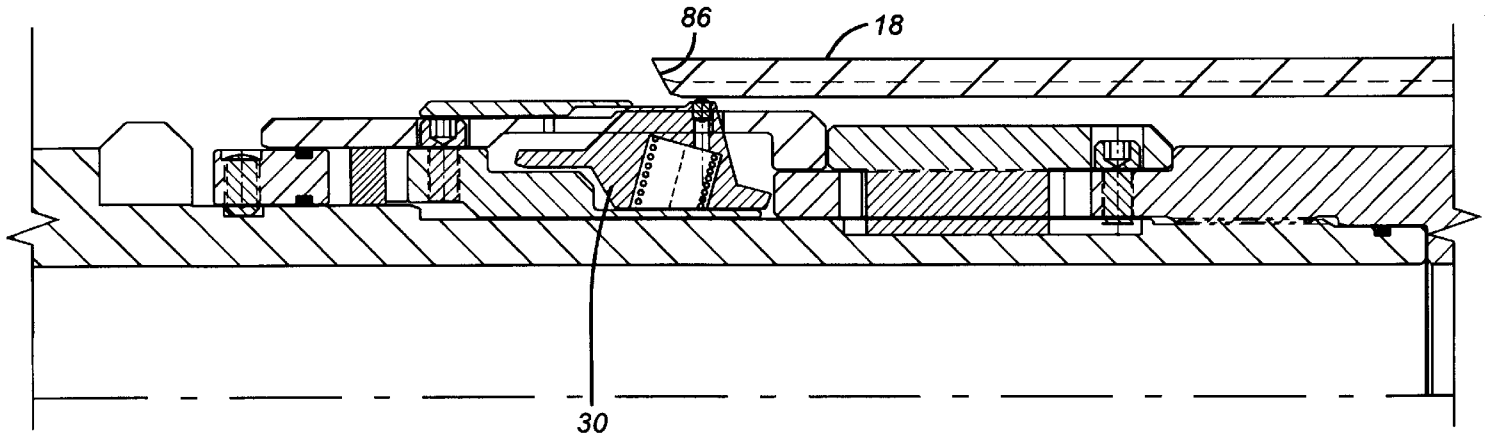
FIGS. 4*a–c* illustrate the breakage of the shear pin retaining the cover sleeve on the dogs.
Figure 5B:
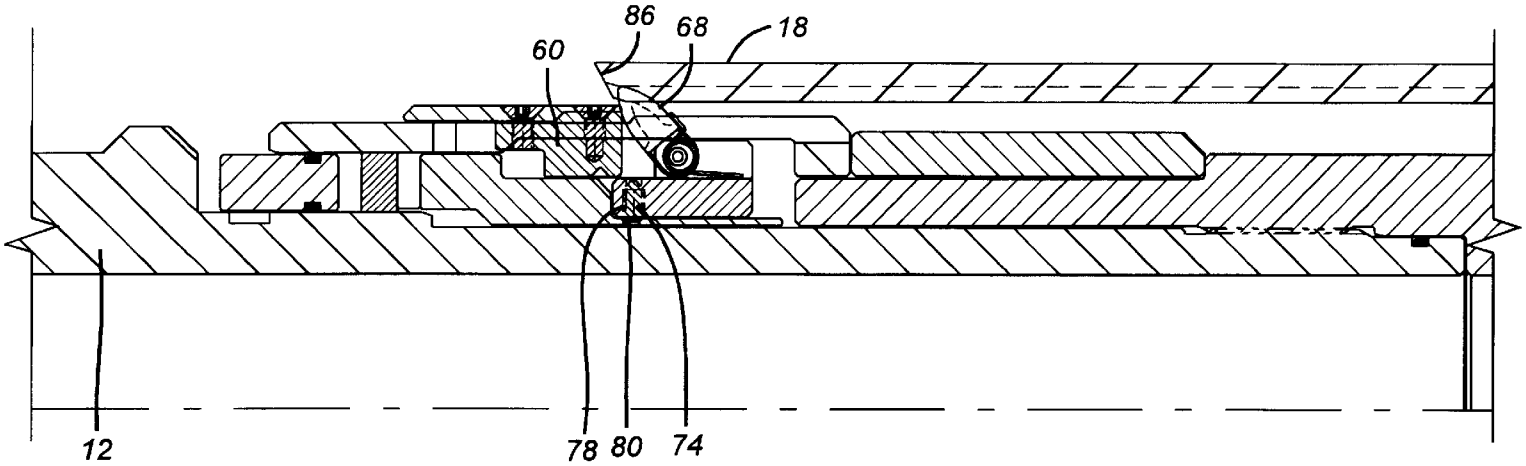
Figure 4B:
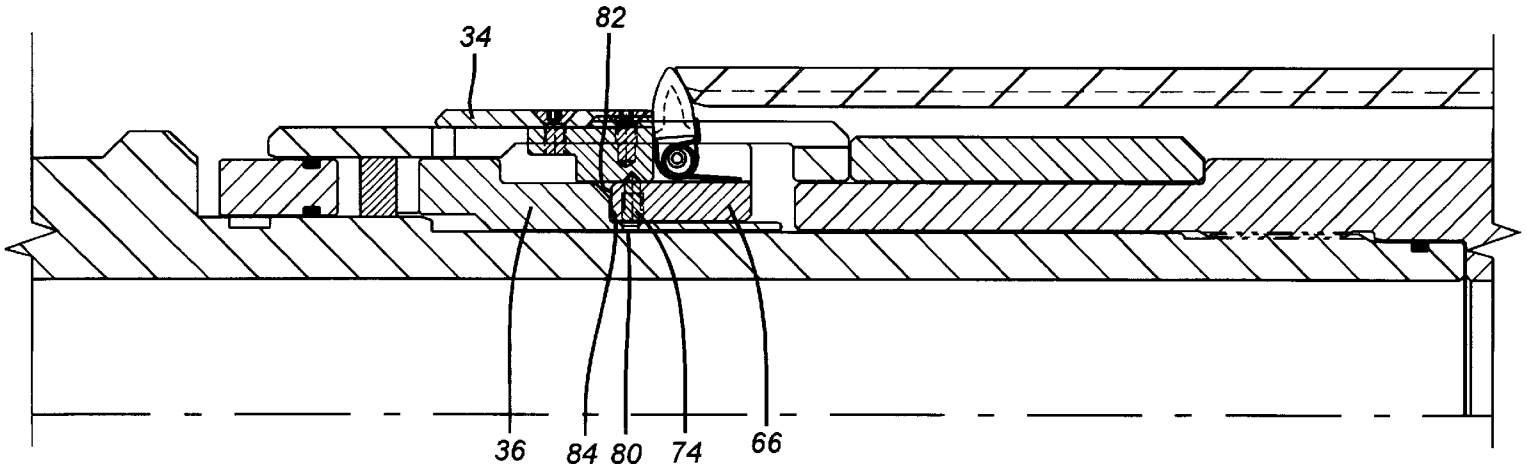

As shown in FIG. 2*c,* the dog retainer sleeve 34 is secured by a shear pin 58 to the cover 38. It can be seen in FIG. 2*b* that the dog retainer sleeve 34 has a guide block 60 secured to it by fasteners 62 and 64. A shifting block 66 supports a plurality of latch fingers 68 which are biased in a counterclockwise direction by a torsion spring 70 about a pivot point 72. A retaining pin 74 extends through shifting block 66 and into a recess 76 in guide block 60. A spring 78 biases the pin 74 away from recess 76. The dog support 36 in FIG. 2*b* further comprises a hole 80 which is shown offset from the pin 74. Those skilled in the art will appreciate that when there is alignment between the hole 80 and the pin 74, as shown in FIGS. 4*b* and 5*b,* that the pin 74 can be biased by spring 78 to retract out of recess 76 for reasons which will be explained below. The shifting block 66 has a top end 82 which is ultimately engageable with dog support 36 on its surface 84 (see FIG. 4*b*).

Figure 1:
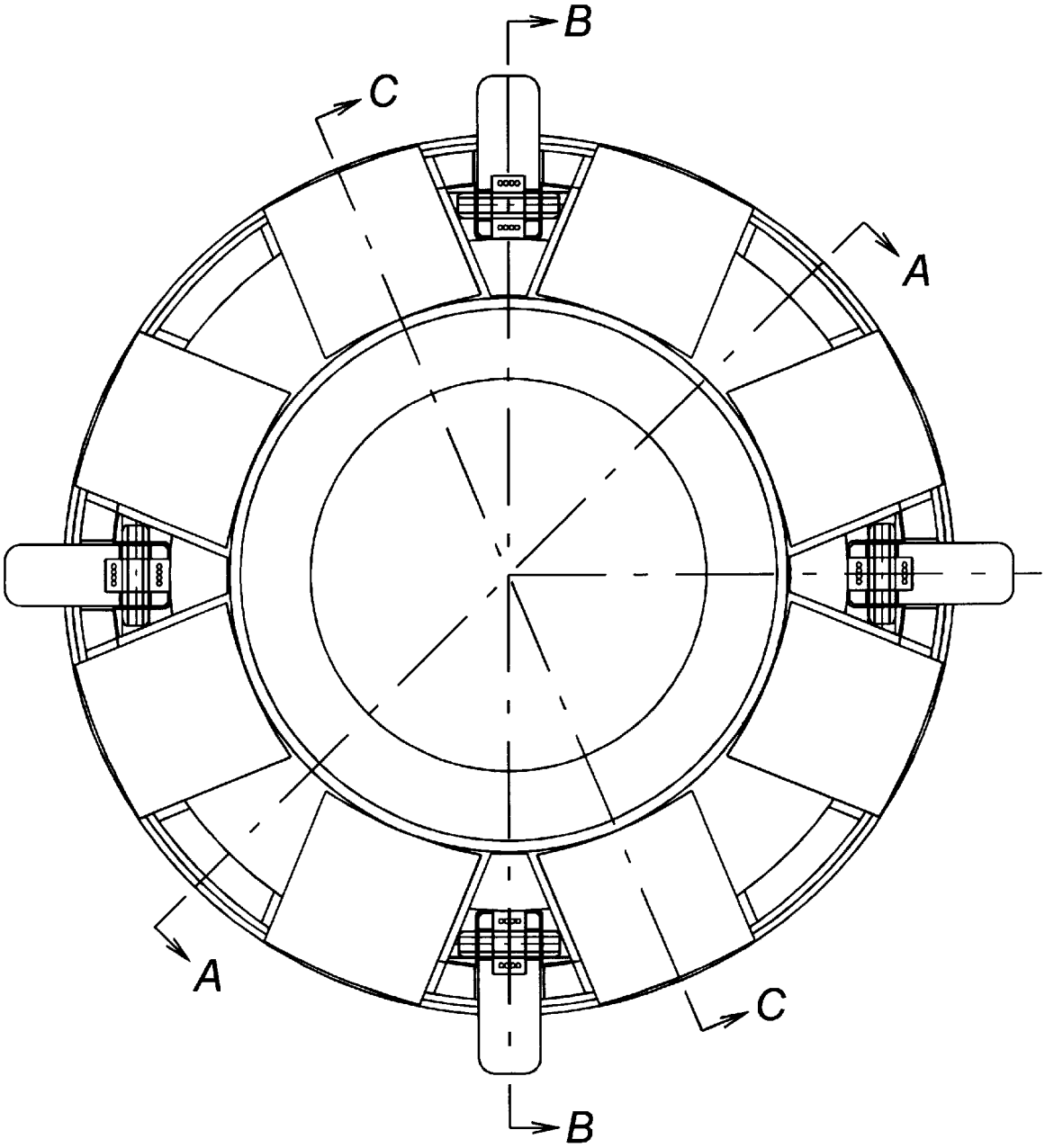
FIG. 1 is a section view through the dog sub of the present invention at the elevation of the dogs and fingers.
Figure 3A:
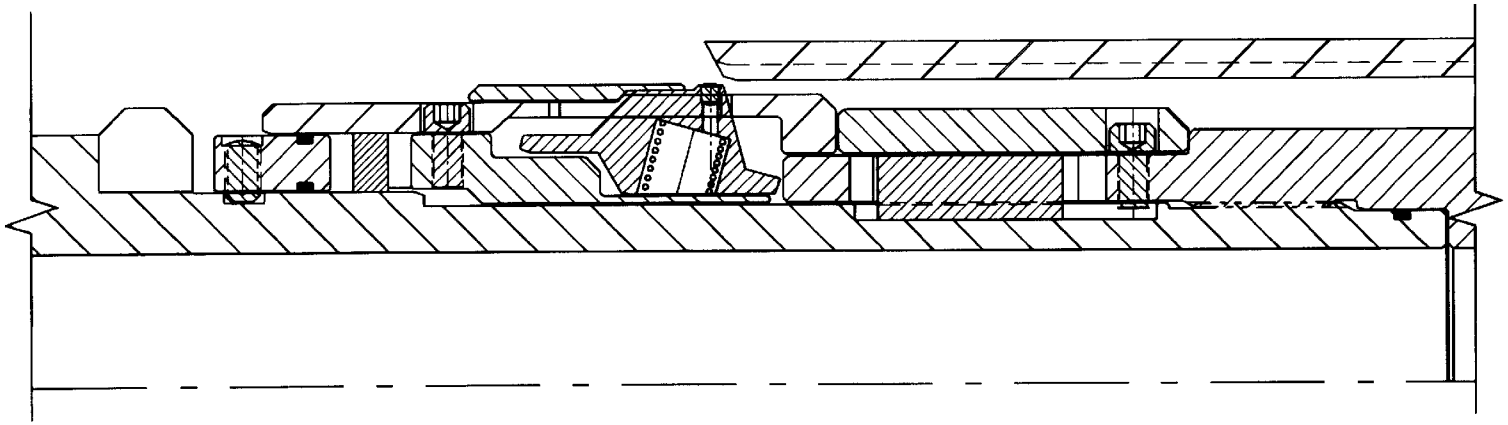
FIGS. 3*a–c* show the dog sub lifted out of the extension tube, with the dogs still retained in a retracted position and indicating the outward extension of the fingers.

The major components of the apparatus now having been described, its operation will be reviewed in greater detail. The run-in position is illustrated in FIGS. 2*a–c*. As shown in FIG. 1, those skilled in the art will appreciate that three separate views at the same elevation of the apparatus are revealed in FIGS. 2*a–c*. The dogs 30 are held in a retracted position by the dog retainer sleeve 34. In the normal sequence of operations, the liner hanger (not shown) has already been set and the surface personnel are now in the position to pick up at the surface to ensure that the running tool (not shown), which is connected to the lower mandrel 10, is free from the liner (not shown). Based on experience and the weight indicator at the surface, the surface personnel will apply an upward force to the top mandrel 12, in effect potentially pulling the dogs 30 completely out of the extension tube 18, if necessary. It should be noted that surface personnel may not actually know if they have pulled the dogs 30 all the way out of the extension tube 18. This is one of the advantages of the present invention in that even though in the process of picking up to determine that there is a release from the liner by the running tool, the fact that the dogs 30 have been pulled outside of the extension tube 18 is immaterial since they will not expand because they are held by the dog retainer sleeve 34. Accordingly, the surface personnel can pick up as high as they desire to obtain sufficient feedback to ensure that the running tool is free from the liner.

Figure 3B:
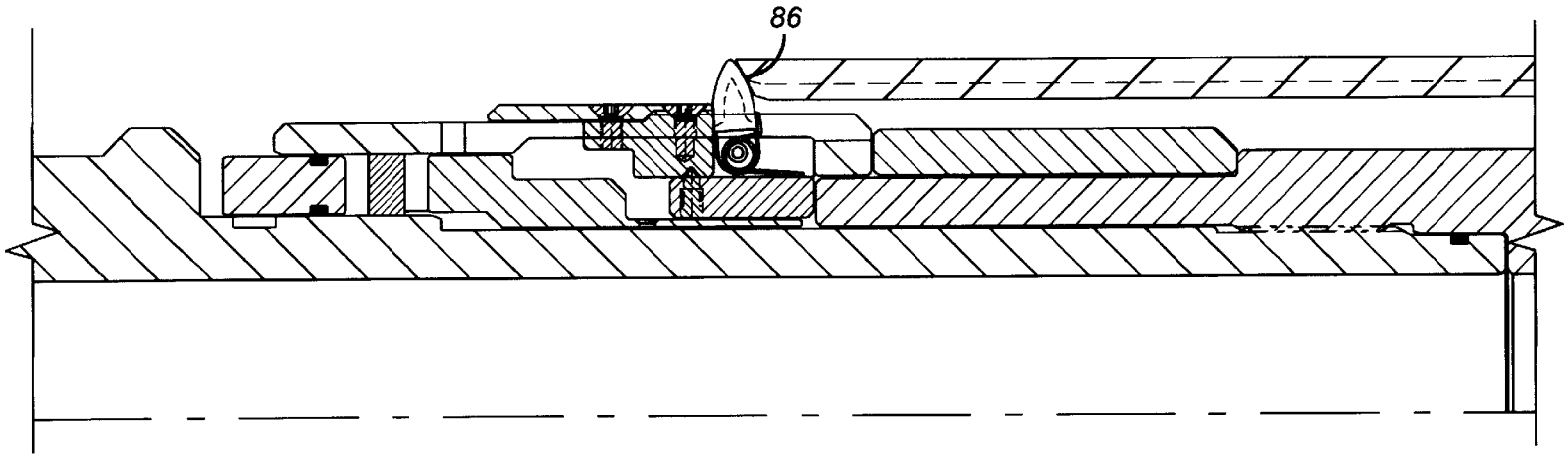

Comparing FIGS. 2*b* and 3*b,* it can be seen that the act of lifting the top mandrel 12 moves the fingers 68 clear of the upper end 86 of extension tube 18. At this time, the torsion spring 70 rotates the fingers 68 counterclockwise. The dog retainer sleeve 34 temporarily stops the counterclockwise rotation of fingers 68 in the position shown in FIG. 3*b*. At the conclusion of the picking up to determine release of the running tool from the liner, the surface personnel will set down weight. As shown in FIG. 4*a,* the dogs 30 (still held by sleeve 34) are now back inside of extension tube 18. The dog support 36, which moves in tandem with the top mandrel 12 due to shear pin 46 and bearing assembly 52 below it, eventually reaches a travel limit as shown in FIG. 4*b,* when surface 84 contacts top end 82 of shifting block 66. At this time the hole 80 aligns with the pin 74. As shown in FIG. 5*b,* when the pin 74 retracts into hole 80 due to the force of spring 78, the shifting block 66 is no longer secured to the guide block 60 to facilitate further advancement of the top mandrel 12 and further counterclockwise rotation of the fingers 68 along the upper end 86 of the extension tube 18.

Figure 3C:
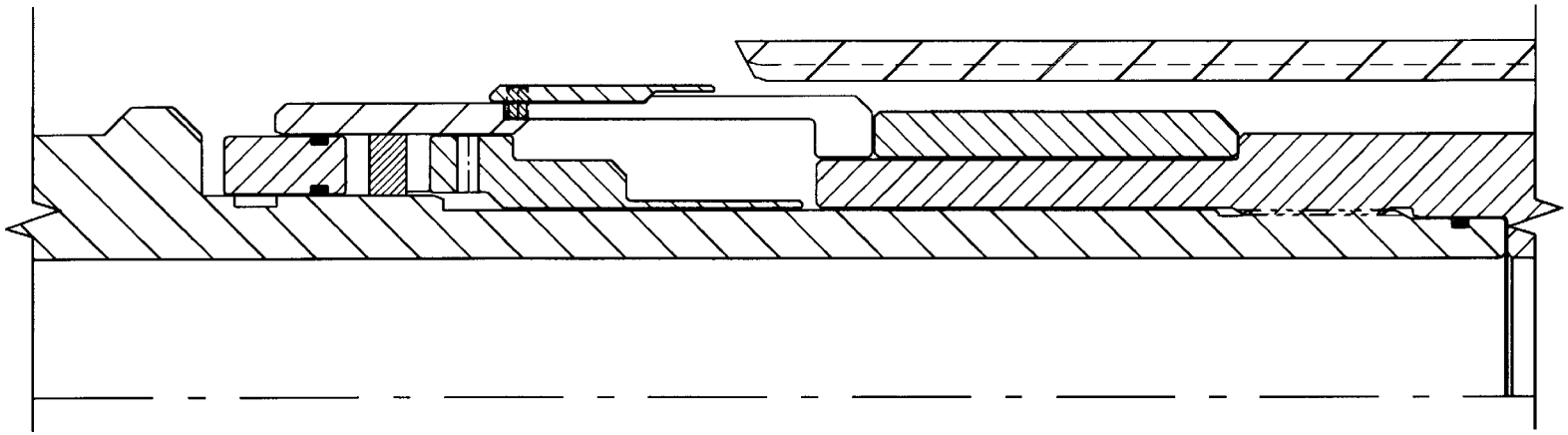
Figure 4C:
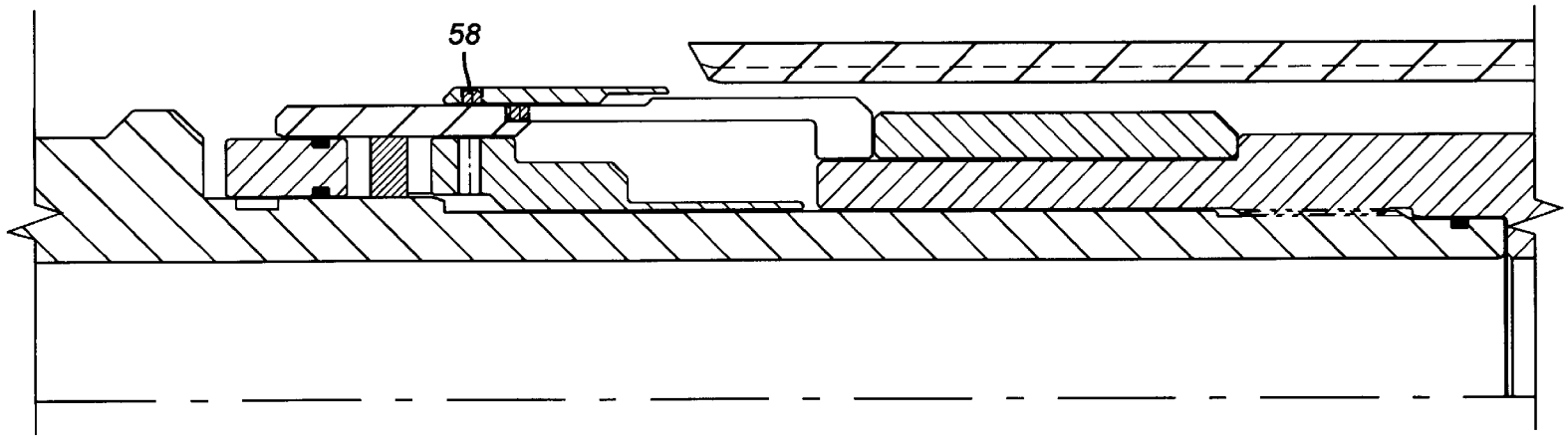

Referring now to FIGS. 3*c* and 4*c,* it can be seen that the shear pin 58 is broken as a result of the fingers 68 which are connected to guide block 66 at pivot point 72, applying an upward force against the dog retainer sleeve 34 in reaction to a setdown weight. It should be noted that the level of force required to break shear pin 58 is significantly less than that required to set the weight-set packer by pushing down on extension tube 18. Accordingly, as shown in FIGS. 3*c* and 4*c,* a setdown force applied from the surface, with the fingers 68 riding the top end 86 of the extension tube 18, results in the breakage of shear pin 58. As earlier noted and shown in FIG. 4*a,* at the time the shear pin 58 breaks, the dogs 30 are past the upper end 86 of the extension tube 18. Once the pin 74 is biased back into hole 80, the continuation of a setdown force from the surface allows the shifting block 66 to move downwardly with respect to the guide block 60, as shown in FIG. 5*b*. Further force is necessarily applied to the dog retainer sleeve 34 as a result of the continued counterclockwise rotation of fingers 68. To prevent marring of the inside surface of extension tube 18 when the dogs, unrestrained by sleeve 34, are pushed down to facilitate cementing, a wear member 31 (see FIG. 5*a*), which can be a soft shear pin or the like, rides on the inside surface of extension tube 18.

Figure 6B:
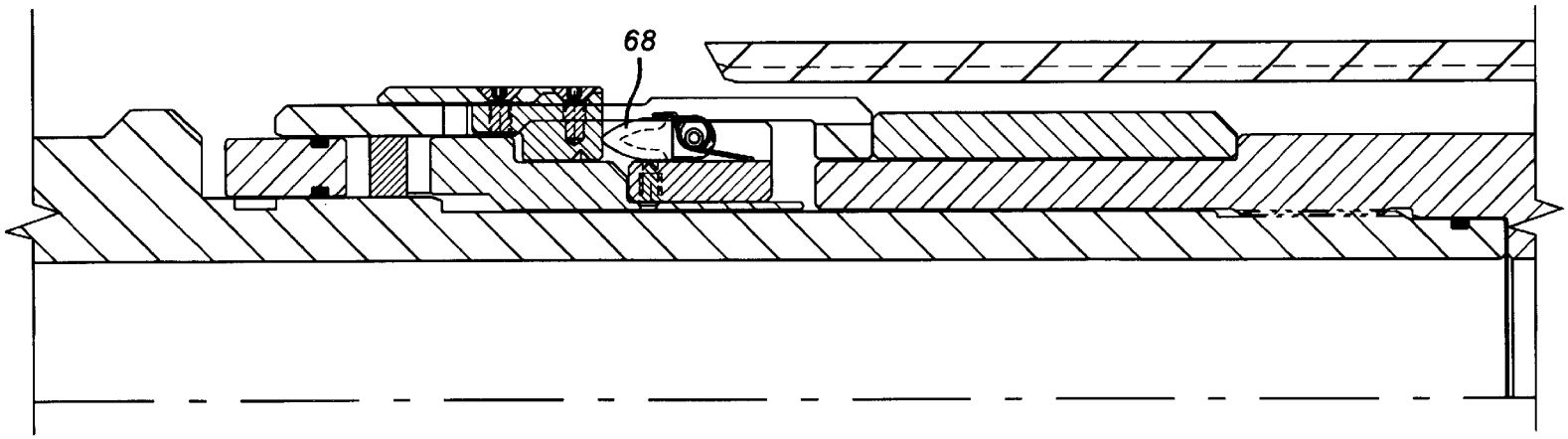
Figure 6C:
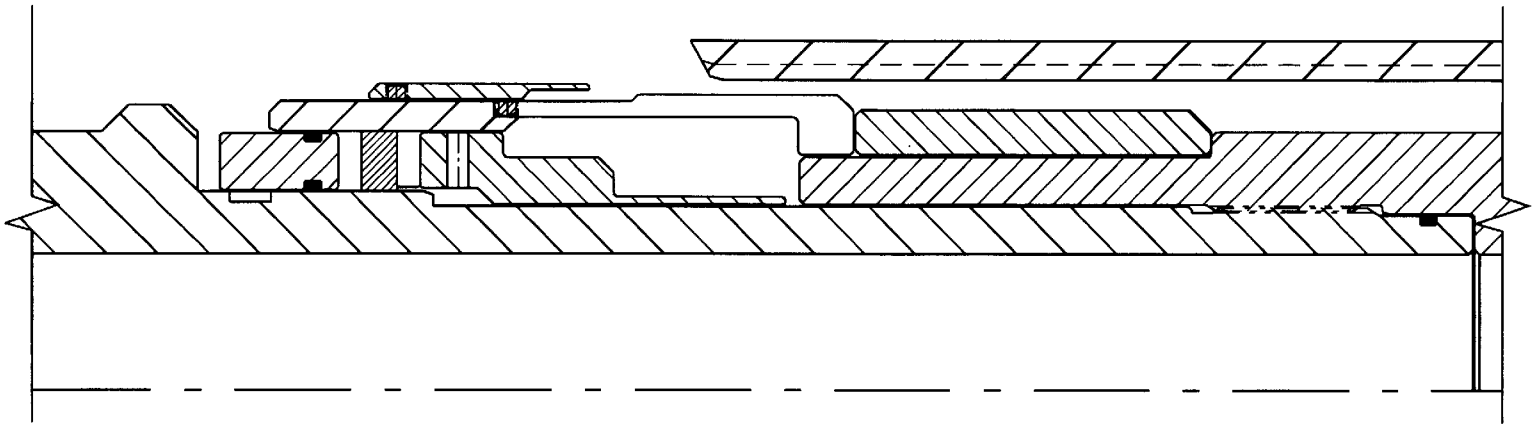

FIGS. 6*a–c* show that on a subsequent pickup force, fingers 68 finish their counterclockwise rotational movement and are now pointing directly uphole, having pushed the guide block 60 further up to better ensure the maximum window height availability for the dogs 30 to pivot outwardly outside of tube 18, as shown in FIG. 6*a*.

Figure 7B:
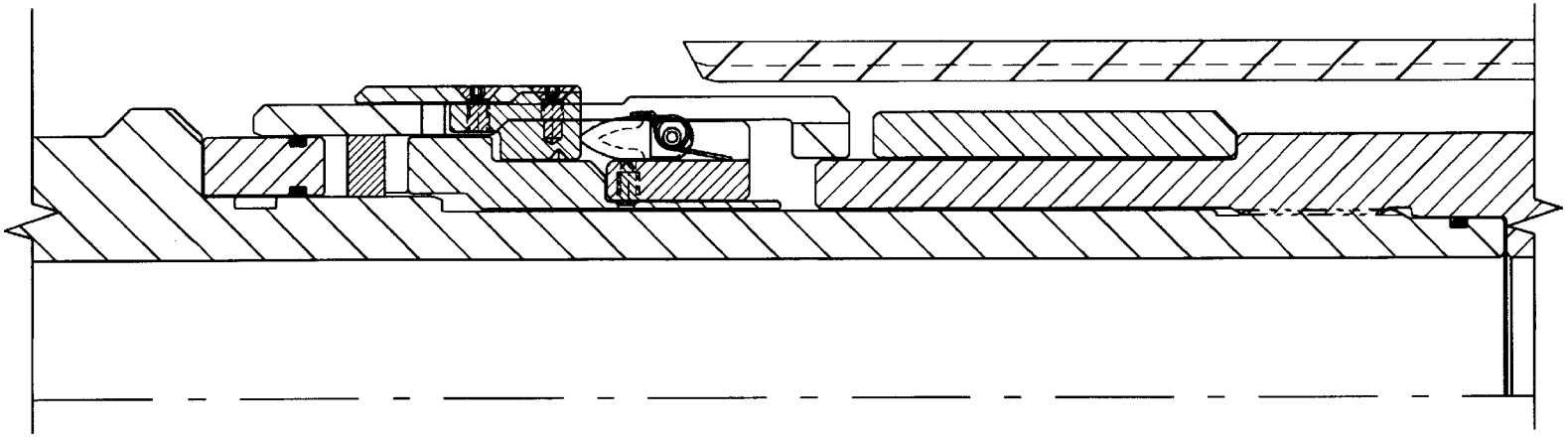
Figure 7C:
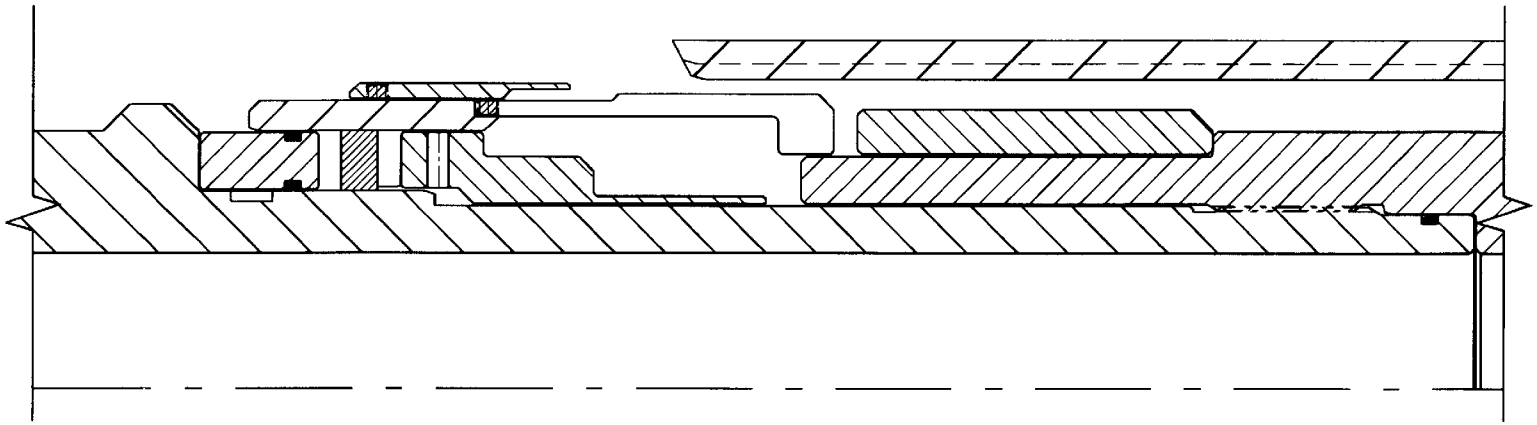

Referring to FIGS. 7*a–c,* it can be now appreciated that a subsequent setdown of weight, with the dogs 30 on the upper end 86 of extension tube 18, will result in an applied force to the extension tube 18 to set the weight-set packer (not shown). Ideally, the shear pin 46 is set for the desired force to be applied to the extension tube 18 to set the weight-set packer. Accordingly, the act of setting the weight-set packer (not shown) will also break the shear pin 46. Thus, when the assembly, including the running tool and the dog sub illustrated, is brought to the surface, surface personnel can see that shear pin 46 has broken. That is the signal that the requisite force has been applied to the weight-set packer through the extension tube 18.

Figure 5C:
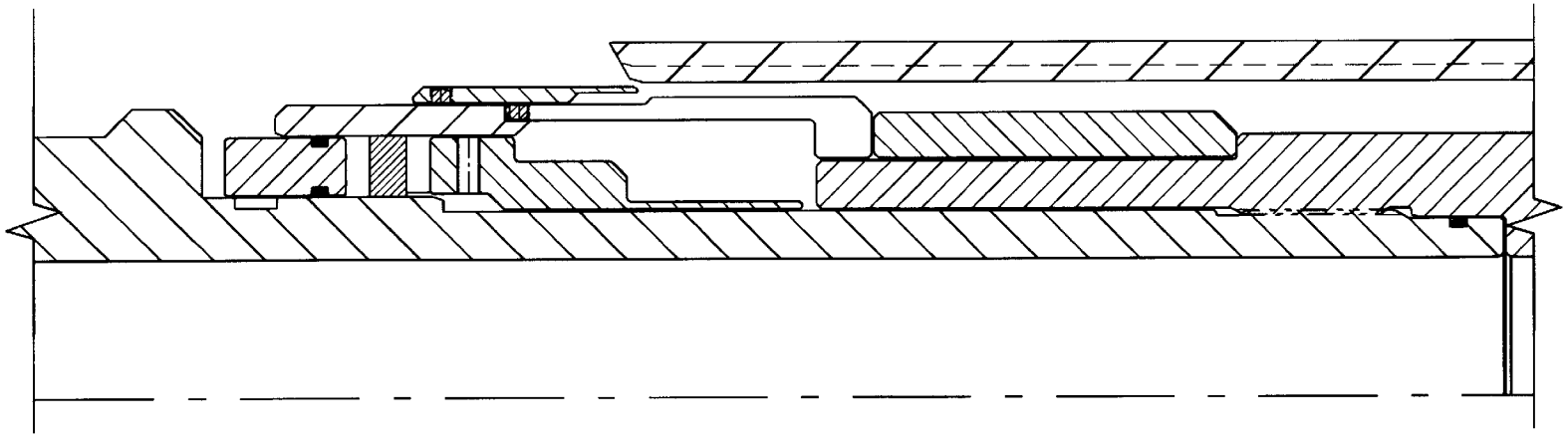

Those skilled in the art can now appreciate the operation of the apparatus and the method employed to provide greater reliability for the downhole operation previously described. One of the main features is that upon application of a pickup force for determination that a release of the running tool from the liner has occurred, it is immaterial that the dogs 30 are withdrawn outside of the upper end 86 of the extension tube 18. Unduly long extension tubes which restrict circulation are not necessary with the apparatus and method of the present invention. The normal steps for subsequent cementing can occur as weight is set down again with the dogs 30 retained by dog retainer sleeve 34, despite extraction of the dogs from the extension tube 18. At this point, in the position shown in FIG. 5, the cementing operation can take place because a setdown force to reposition the running tool in the liner has occurred. Coincidentally, the setdown force repositions the dogs back inside the extension tube 18 and allows the shear pin 58 to break so as to liberate the dogs 30 to rotate counterclockwise under the force of springs 32 when they are later picked up out of tube 18. A subsequent pickup force allows the dogs 30 to be pivoted outwardly by springs 32 so as to catch the upper end 86 of the extension tube 18. A further setdown force will set the liner packer and ultimately break the shear pin 46 for the subsequent surface signal when the dog sub is brought to the surface. At this point, the tool can be used to locate another mechanical or hydraulic device in the liner string. Alternatively, it can be used in a liner string without a liner top packer where it can locate a mechanical or hydraulic device. It should be noted that the first upward pull to disconnect the running tool from the liner can now be done with confidence because it is known that the dogs 30 will not catch on the top end 86 of the extension tube 18. It is only after subsequent picking up after breakage of shear pin 58 that the dogs 30 will catch on upper end 86 for setting the liner packer.

The foregoing disclosure and description of the invention are illustrative and explanatory thereof, and various changes in the size, shape and materials, as well as in the details of the illustrated construction, may be made without departing from the spirit of the invention.

What is claimed is:

1. A downhole setting tool used to actuate a downhole tool having a setting sleeve by setting down weight, comprising:

a body;

at least one dog biased away from said body and selectively retained to said body;

said dog removable at least once from the setting sleeve during release from the downhole tool so that upon setting down said body said dog will not set weight down on the setting sleeve.

2. The tool of claim 1, further comprising;

at least one retainer mounted over said dog which prevents outward movement of said dog, said retainer selectively movable to allow said dog to be outwardly biased.

3. The tool of claim 2, wherein:

said body further comprises a latch said latch outwardly extendable for engaging a top of the setting sleeve when removed from said setting sleeve.

4. The tool of claim 3, further comprising;

a breakable connection holding said retainer in place;

said latch when in contact to the top of the setting tube allows a set down force to said body to move said retainer by breaking said breakable connection.

5. The tool of claim 4, wherein:

said dog is inside the setting tube when said breakable connection is broken.

6. The tool of claim 5, wherein:

said latch is pivotally mounted;

said dog mounted to said body by a dog housing;

said latch, when removed from the setting tube engaging said dog housing in a position where it can support said body on the setting sleeve.

7. The tool of the claim 6, wherein:

said dog housing comprises a window;

said retainer spanning said window to retain said dog;

said retainer when no longer retained by said breakable member is displaced by said bias on said dog as said dog moves through said window.

8. The tool of claim 7, wherein:

said dog housing is retained to said body by a second breakable member;

said second breakable member when broken by set down weight of said body with said dog on top of the setting sleeve serves as an indicator that a predetermined force has been applied to the setting sleeve.

9. The tool of claim 8, wherein:

said dog is mounted to said body to allow said body to rotate with the dog remaining stationary.

10. A method of setting a tool having a setting sleeve, comprising:

inserting a setting tool into a setting sleeve of a downhole tool;

providing at least one dog on said setting tool which is initially retained retracted to the body of said setting tool;

removing said dog from said sleeve when releasing said setting tool from the downhole tool;

retaining said dog retracted to allow reentry of said dog into said sleeve without weight set down on top of said sleeve through said dog.

11. The method of claim 10, further comprising:

extending a latch out of said setting tool to engage the setting sleeve when said dog is inside the setting sleeve;

using said latch to release a retainer for said dog in response to set down weight on said latch.

12. The method of claim 11, further comprising:

removing said dog from the setting sleeve after set down weight is applied to said latch;

applying set down weight to the setting down weight;

using said broken breakable member as an indicator that a predetermined force has been applied to the setting sleeve.

13. A method of releasing a setting tool from a downhole tool and re-engaging the downhole tool without actuation of a setting member on the downhole tool comprising:

releasing support for the downhole tool by said setting tool;

removing at least one setting dog from the setting member; and retaining said setting dog so that upon reversal of movement said setting dog will not set the downhole tool.

14. The method of claim 13, further comprising:

releasing said dog, while its movement is limited by said setting member, to move toward an actuating position with respect to said setting member;

removing said dog from contact with said setting member;

allowing said dog to move so that upon setting down weight it engages said setting member to activate said downhole tool.

15. The method of claim 14, further comprising:

breaking a breakable member by said setting down weight with said dog bearing on said actuating member;

using the breaking of said breakable member as a signal that a predetermined force has been applied to the setting member.

16. The method of claim 14, further comprising:

retaining said dog with a retainer;

securing said retainer with a breakable member;

providing a latch which extends to a position to engage the setting member and said retainer when said latch is moved out of contact with the setting member and back into contact;

setting down weight to break said breakable member;

using bias on said dog to displace said dog past said retainer.

17. The method of claim 13, further comprising:

using a liner hanger with a packer as the downhole tool;

using a setting sleeve on said packer as the setting member;

mounting said dog on said setting tool so that it can remain stationary as the body of said setting tool is rotated.

18. The method of claim 13, further comprising:

using a liner hanger with a packer as the downhole tool;

using a setting sleeve on said packer as the setting member;

actuating said liner hanger;

cementing a liner supported by said liner hanger when said setting tool is held inserted in said setting sleeve after a previous indication at the surface that said setting tool is no longer supporting said packer.

19. The method of claim 18, further comprising:

using a retainer to hold said dog from engaging the top of said setting sleeve if initially removed from said setting sleeve to determine that said setting tool no longer supports said packer;

allowing a latch to move outwardly to engage the top of said setting sleeve;

providing a breakable member on said retainer which breaks with a force smaller than that required for moving said setting sleeve to set said packer;

breaking said breakable member with set down weight on said latch.

20. The method of claim 19, further comprising:

providing a second breakable member operably connected to said dog;

breaking said second breakable member with set down weight on said setting sleeve through said dog;

sensing said second breakable member being broken as a signal that sufficient force has been applied to said setting sleeve to set said packer.

* * * * *